US007770554B2

(12) United States Patent
Chigira et al.

(10) Patent No.: US 7,770,554 B2
(45) Date of Patent: Aug. 10, 2010

(54) RECOIL STARTER

(75) Inventors: Shigemitsu Chigira, Tokyo (JP); Tetsuya Kasamatsu, Tokyo (JP); Kenta Shofuda, Tokyo (JP); Hiroaki Saito, Tokyo (JP); Yuki Hoshi, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 12/249,223

(22) Filed: Oct. 10, 2008

(65) Prior Publication Data

US 2009/0107445 A1 Apr. 30, 2009

(30) Foreign Application Priority Data

Oct. 25, 2007 (JP) ..... P2007-277592

(51) Int. Cl.
*F02N 1/00* (2006.01)

(52) U.S. Cl. ..... 123/185.3; 74/6

(58) Field of Classification Search ... 123/185.2–185.4, 123/185.14; 417/364, 323; 74/6; *F02N 1/00*
See application file for complete search history.

(56) References Cited

U.S. PATENT DOCUMENTS 7,409,942 B2 * 8/2008 Hashiba ..... 123/185.3
7,458,355 B2 * 12/2008 Fujita et al. ..... 123/185.3

FOREIGN PATENT DOCUMENTS

JP 2002138929 A * 5/2002
JP 2006-132519 5/2006

* cited by examiner

*Primary Examiner*—Stephen K Cronin
*Assistant Examiner*—Keith Coleman
(74) *Attorney, Agent, or Firm*—Nixon & Vanderhye P.C.

(57) ABSTRACT

A recoil starter includes a base plate that has a bearing portion formed therein and a rotary shaft that is supported by the bearing portion so as to pass through the base plate. A rope reel is rotatably supported at one side of the base plate, and a recoil rope is wound around the rope reel. A recoil spiral spring urges the rope reel to rewind the recoil rope. A damper spring has one end connected to the rotary shaft and the other end connected to the rope reel, and a clutch mechanism is disposed on an end of the rotary shaft at the other side of the base plate. The clutch mechanism transfers a rotational force to an engine.

7 Claims, 4 Drawing Sheets

RECOIL STARTER

CROSS-REFERENCE TO RELATED APPLICATIONS

The entire disclosure of Japanese Patent Application No. 2007-277592 filed on Oct. 25, 2007 including specification, claims, drawings and abstract is incorporated herein by reference in its entirety.

BACKGROUND OF THE INVENTION

1. Field of the Invention

An aspect of the present invention relates to a recoil starker in which a rope reel is rotated by pulling a recoil rope wound therearound, and a rotation force of the rope reel is transferred to a clutch mechanism to start an engine via a damper spring.

2. Background Art

Generally, a speed adjustment unit equipped with a throttle lever is mounted on the pipe handle of a soil and vegetation management machine, such as a string trimmer, a rotary tiller, a rice transplanter or a lawn mower, and the rotation speed of an engine is controlled by adjusting the pulling amount of the throttle lever. For example, for a string trimmer, a throttle adjustment unit is mounted near a grip on a pipe handle to control the rotation speed of an engine. This throttle adjustment unit is so designed that an engine, such as a gasoline engine, is mounted on one end of a pipe handle, and a rotary blade to be driven by the engine is provided on the other end via a drive shaft fitted into the pipe handle.

A recoil starter for starting the engine can be provided on the pipe handle. A related-art recoil starter has a structure in which a rope reel and a cam member that serves as a clutch mechanism are elastically connected through a coil-shaped damper spring located therebetween, and in which the rotation force of the rope reel accumulated by pulling a recoil rope is transferred to the cam member via the damper spring. The rotational force transferred to the cam member can then be transferred to, and used to start, the engine (see, for example, JP-2006-132519-A).

According to the structure of the related-art recoil starter, a shaft portion is integrally formed with the starter case, and the rope reel and the bearing of the cylindrical cam member (around which the damper spring is wound) are rotatably supported on the shaft portion. Since the shaft portion is formed short, the shaft can not support the rope reel and the cam member along the entire lengths, and merely holds them along only one side. Further, while the starter case is secured to the crankcase of the engine, the shaft portion is not stably provided because it is located away from the crankcase. In addition, since the rope reel and the cylindrical cam member are arranged on the shaft portion of the starter case, high rigidity is required for the starter case to ensure smooth rotations.

When simply moving the shaft portion from the starter case side to the crankcase side, the recoil reel is positioned at the distal end of the shaft portion and protrudes from the crankcase. The damper spring is disposed between the recoil reel and the cam member that is to be positioned at the proximal end of the shaft portion. Since the damper spring is formed in a coil shape and requires a certain length, the rope reel is positioned at a distance from the crankcase. Therefore, the shaft and the supporting structure for the shaft must be formed rigidly.

SUMMARY OF THE INVENTION

The present invention resolves these shortcomings, and one objective of the invention is to provide a recoil starter that can reduce the operating load imposed on a rope reel, and that can ensure a steady smooth operation.

According to an aspect of the present invention, there is provided a recoil starter including: a base plate that has a bearing portion formed therein; a rotary shaft that is supported by the bearing portion so as to pass through the base plate; a rope reel that is rotatably supported at one side of the base plate; a recoil rope that is wound around the rope reel; a recoil spiral spring that urges the rope reel to rewind the recoil rope; a damper spring that has one end connected to the rotary shaft and the other end connected to the rope reel; and a clutch mechanism that is disposed on an end of the rotary shaft at the other side of the base plate and that transfers a rotational force to an engine.

The base plate may include a partition wall that covers an opening of on a crankcase.

The base plate may be disposed to cover an opening formed on a case of the engine.

According to such a configuration, a bearing is mounted on a partition wall that closes a side opening in an engine crankcase, and a clutch mechanism is provided on the crankcase end of a rotary shaft that passes through the bearing, while a rope reel is provided on the opposite end of the rotary shaft and a damper spring is positioned outside the rope reel. Since the clutch mechanism on which a load is imposed during transferring a rotational force to the engine and the rope reel on which a load is imposed by the withdrawal of the recoil rope are positioned at either end of the bearing, the effective load on the bearing can be reduced, and a steady, smooth operation can be obtained. In addition, a special strength is not required for the starter case that covers the recoil starter.

The recoil spiral spring may be disposed between the base plate and the rope reel.

According to such a configuration, since a recoil spiral spring is located between the partition wall and the rope reel, after the recoil rope has been pulled out to start the engine, the rope is automatically rewound on the rope reel by the recoil spiral spring, and the damper spring having a larger axial length as compared with the recoil spring is disposed on the opposite side of the rope reel. This arrangement permits the rope reel to be positioned nearer the bearing.

BRIEF DESCRIPTION OF THE DRAWINGS

Embodiments may be described in detail with reference to the accompanying drawings, in which.

DETAILED DESCRIPTION OF THE EMBODIMENTS

Figure 1:
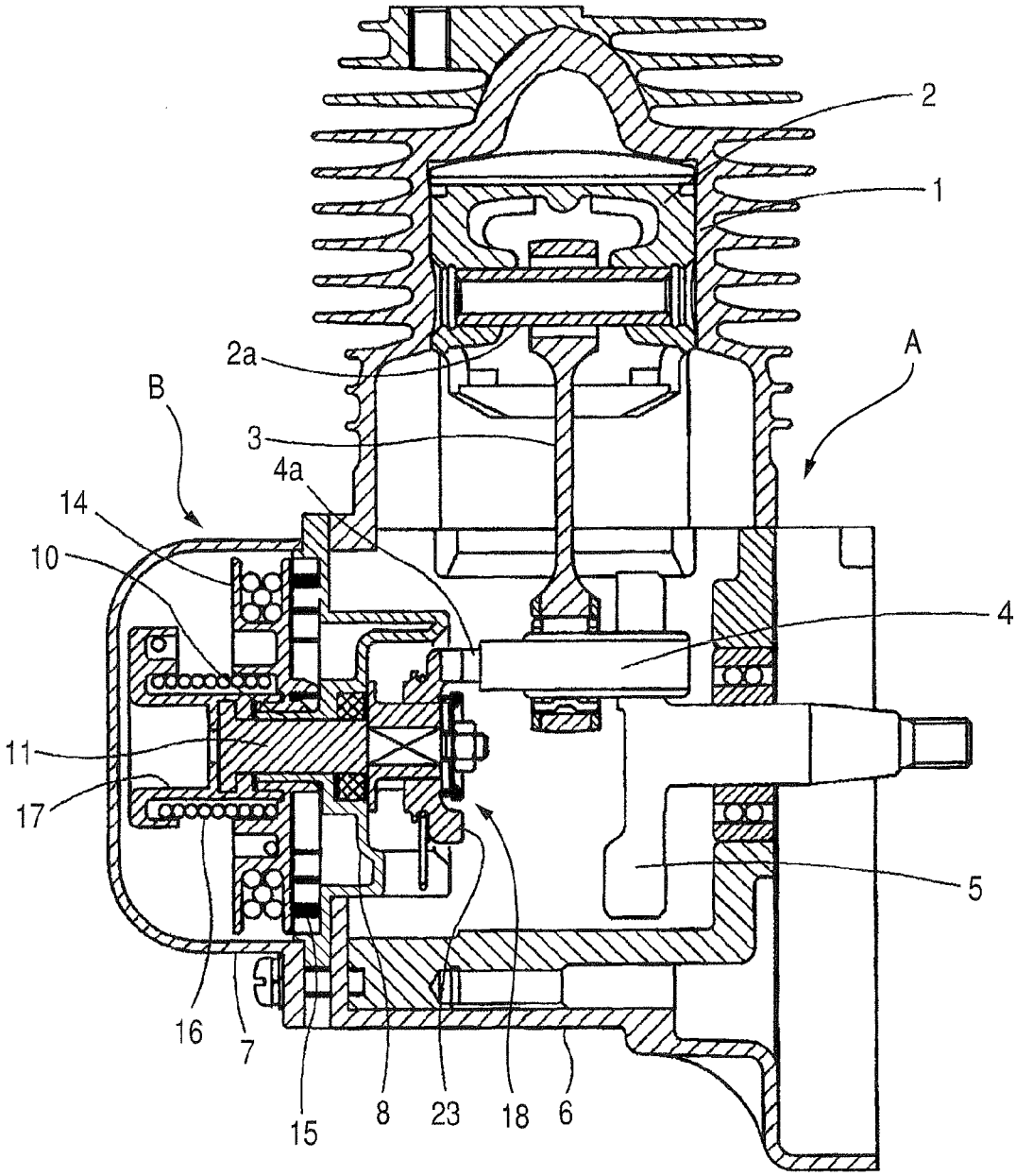
FIG. 1 is a general cross-sectional view of an engine starting apparatus according to an embodiment of the present invention.

An engine A is shown in FIG. 1. In the engine A, a cylinder 1 that accommodates a piston 2 so that the piston 2 is freely reciprocatable within the cylinder 1 is provided. The piston 2 is connected to one end of a connecting rod 3 via a piston pin 2*a*. The other end of the connecting rod 2 is connected to a crankshaft 4 that is arranged within a crankcase 6. In the crankcase 6, a flywheel 5 is provided. The crankshaft 4 is rotatably supported by the flywheel 5 at one end of the crankshaft 4. At the other end of the crankshaft 4, a crankshaft pin 4*a* is provided so as to be engageable with a recoil starter B, which will be described below.

A starter case 7 that covers the recoil starter B is provided at an opening formed in the crankcase 6 of the engine A. As illustrated in detail in FIG. 2, a partition wall 8 is formed to close the opening of the crankcase 6. A cylindrical bearing 10 is formed to project from the center of the partition wall 8 toward the opposite side of the crankcase 6. A rotary shaft 11 is provided to pass through and to be rotatably supported by the bearing 10.

A rope reel 14 having a U-shaped groove 13 on which the recoil rope 12 is wound is rotatably supported around the outer face of the bearing 10. One end of the recoil rope 12 is led outside the starter case 7, while the other end is fixed to the rope reel 14. A recoil spiral spring 15 is arranged between the rope reel 14 and the partition wall 8. When the rope reel 14 has been rotated forward by pulling the recoil rope 12 and the recoil rope 12 is released, the recoil spiral spring 15 drives the rope reel 14 in reverse to rewind the recoil rope 12. To accomplish this, the inner end of the recoil spiral spring 15 is fixed to the partition wall 8, and the outer end is fixed to the rope reel 14. Thus, as the recoil rope 12 is pulled and the rope reel 14 is rotated, rotational force is accumulated by the recoil spiral spring 15, and when the recoil rope 12 is released, the rope reel 14 is rotated in reverse by the accumulated rotational force of the recoil spiral spring 15, and the recoil rope 12 is rewound on the rope reel 14.

A winding drum 17 is continuously formed with the rotary shaft 11 at the end away from the crankcase 6. A damper spring 16 shaped like a coil spring is wound on the winding drum 17. The base portion of the winding drum 17 is embedded within a recessed portion 19 that is formed in the side face of the rope reel 14, on the inner wall side of the U-shaped groove 13. One end 16*a* of the damper spring 16 is secured to the distal end of the winding drum 17, while an end 16*b* is secured to the rope reel 14.

Figure 2:
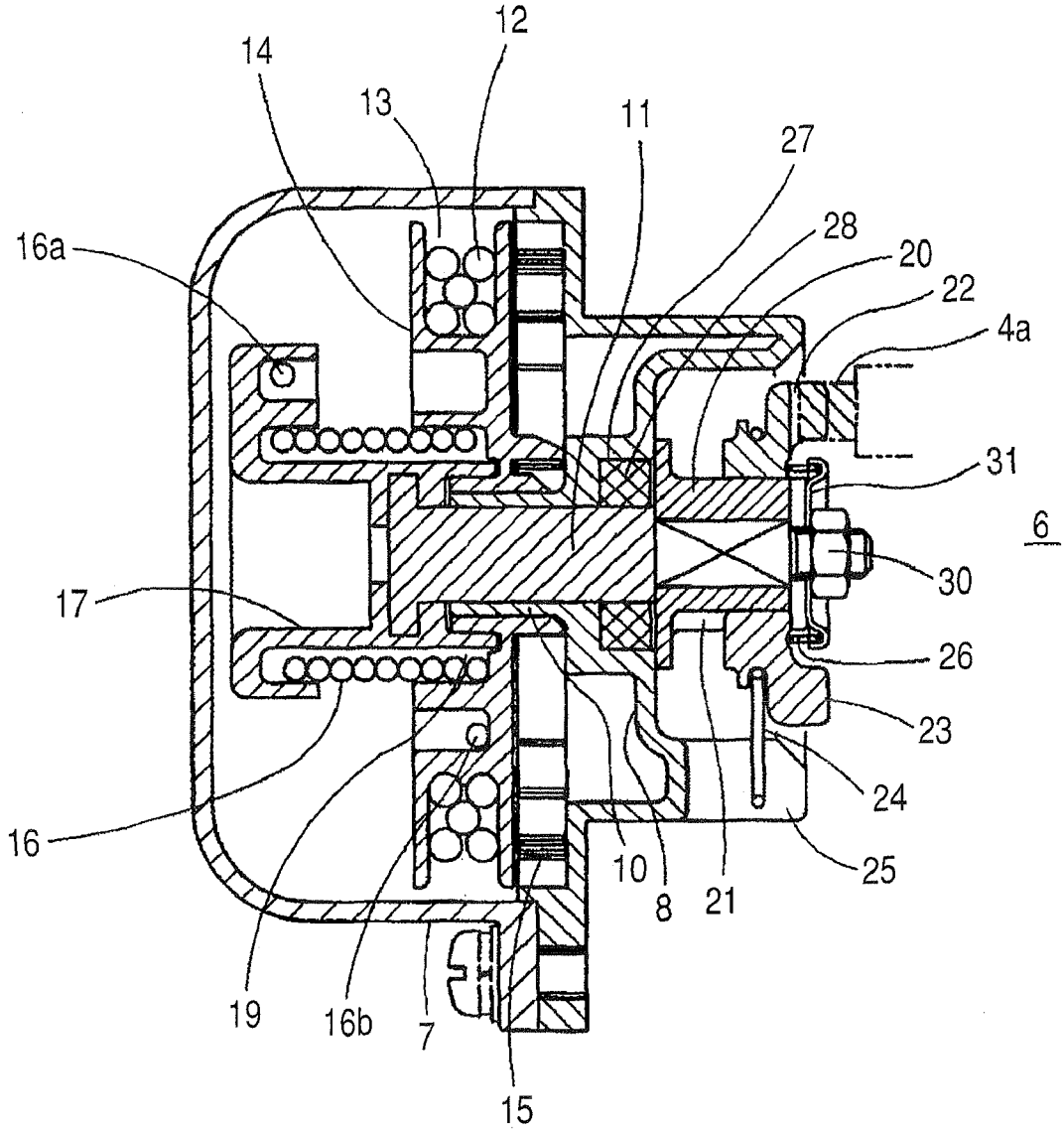
FIG. 2 is a cross-sectional view of a recoil starter according to the embodiment in the normal (in active) state.
Figure 3:
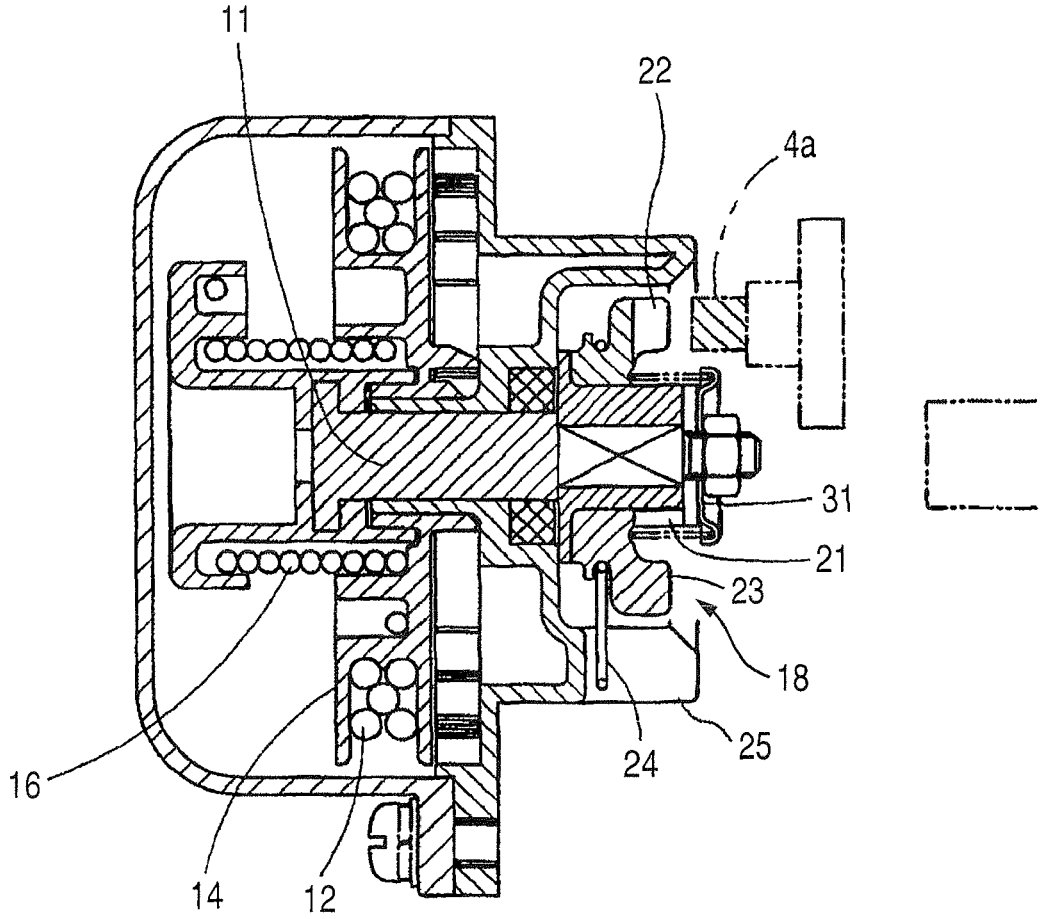
FIG. 3 is a cross-sectional view of the recoil starter in the started state.

Furthermore, a clutch mechanism 18 for transferring a rotational force is provided on the rotary shaft 11 at the end of the crankcase 6 side. Part of the rotary shaft 11 projects outward, to the crankcase 6, and a sleeve 20 is fixed to the outer wall of the projected portion. In addition, a screw spline 21 is attached to the outer wall of the sleeve 20, and a cam 23 having a plurality of pawls 22 is fitted on the screw spline 21. A friction spring 24 is attached to the cam 23 by compression bonding, and the rotation of the friction spring 24 is regulated by a guide 25 arranged on the starter case 7. Thus, in a normal (inactive) state, the friction spring 24 is positioned at the left of the screw spline 21 as shown in FIG. 3. But when rotation of the rotary shaft 11 has begun, and the rope reel 14 is rotating as the recoil rope 12 is being pulled, the screw spline 21 and the cam 23 are fitted together, and the cam 23 is moved to the right. As a result, a pawl 22 on the cam 23 engages a crank pin 4*a* as shown in FIG. 2. It should be noted that for this arrangement, a washer 31 is fixed to the distal end of the rotary shaft 11 by a bolt 30, and that a return spring 26, located between the washer 31 and the cam 23, applies a constant pressure to impel the cam 23 to the left. Further, an oil seal 28 is disposed in a recessed portion 27, which is formed in the partition wall 8 near the rear face of the base of the bearing 10, so that water, mud and dust, for example, will not enter the clutch mechanism 18, or electric and electronic parts in the engine A, through an open space between the partition wall 8 and the rotary shaft 11.

The operation of the recoil starter B having this arrangement will now be described.

At first, by pulling the recoil rope 12, rotation of the rope reel 14 is started. While the recoil spiral spring 15 is wound, a rotational force of the rope reel 14 is transferred to the rotary shaft 11 via the damper spring 16 and to the cam 23. In the initial state, the cam 23 is not rotated when the rotational force is transferred, since the friction spring 24 holds the cam 23 as shown in FIG. 3. As the recoil rope 12 continues to be pulled, the damper spring 16 is further wound in consonance with the rotation of the rope reel 14, and the rotary shaft 11 begins to rotate against the rotational resistance of the friction spring 24 by the force accumulated in the damper spring 16. Thereafter, as the rotary shaft 11 is rotated, the cam 23 is moved toward the engine A along the guide 25 and the screw spline 21 and is engaged with a crank pin 4*a*, as shown in FIG. 2. Subsequently, as the rotation of the rope reel 14 continues, the movement of the cam 23 toward the engine A is regulated by the washer 31, and the cam 23 begins to rotate with the rope reel 14, thereby rotating the crank pin 4*a*. The crank pin 4*a* and the crankshaft 4 are rotated, thereby reciprocating the piston 2 within the cylinder 1 through the connecting rod 3 and starting the engine A.

When the engine A has been started and the recoil rope 12 has been released, the recoil spiral spring 15 rewinds the recoil rope by rotating the rope reel 14 in reverse, while the cam 23 is returned to the position shown in FIG. 3.

According to this recoil starter B arrangement, the partition wall 8 is provided so as to close the opening of the crankcase 6, the bearing 10 is formed on the partition wall 8, and the rotary shaft 11 is provided to pass through the bearing 10. Here, the clutch mechanism i8 is provided on the rotary shaft 11 at the side facing the engine A, and the rope reel 14 is arranged at the other side while the damper spring 16 is located further outside of the rope reel 14. Accordingly, the clutch mechanism 18 on which a load is imposed during transferring a rotational force and the rope reel 14 on which a load is imposed by pulling the recoil rope 12, are arranged at either side of the bearing 10. Therefore, a load imposed on the bearing 10 is minimized, and a steady and smooth operation can be ensured.

Furthermore, as a starter case 7 covering the recoil starter B, a special rigidity is not required.

In addition, the recoil spiral spring 15 is located between the partition wall 8 and the rope reel 14, and the damper spring 16 having a larger axial length as compared with the recoil spiral spring 15 is located on the side opposite (outside) the rope reel 14. Therefore, the rope reel 14 can be located nearer the bearing 10.

Figure 4:
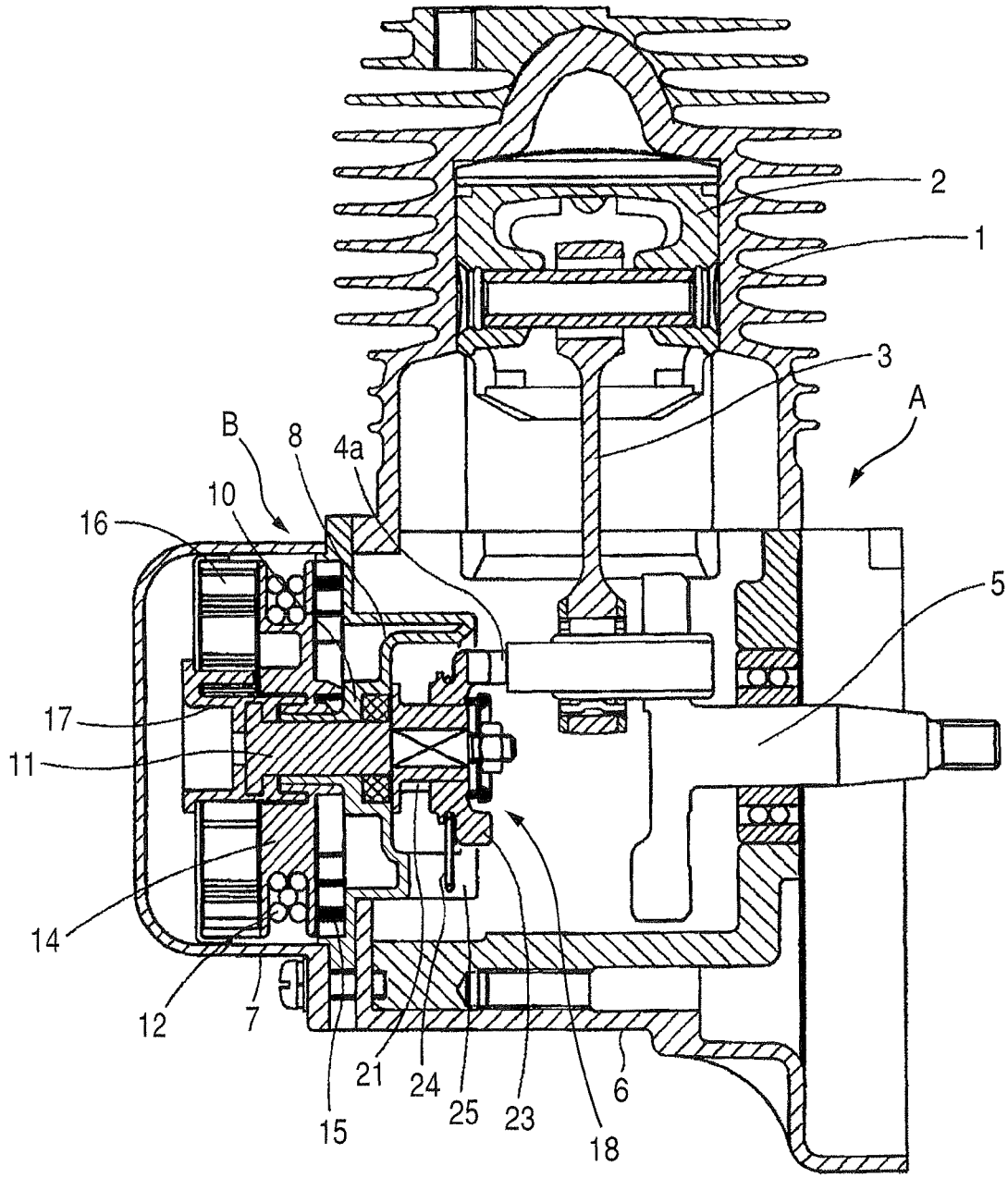
FIG. 4 is a cross-sectional view of a recoil starter according to another embodiment of the present invention.

The damper spring 16 is not limited to the above described example, i.e., a coil spring, and may be formed like a spiral spring, as shown in FIG. 4. In this case, an end 16*a* of a damper spring 16 is secured to the distal end of a winding drum 17 of a rotary shaft 11, and the other end 16*b* is secured to a rope reel 14. It should be noted that the same reference numerals as used in FIGS. 1 to 3 are employed to denote corresponding components in FIG. 4.

What is claimed is:

1. A recoil starter comprising:

a base plate that has a bearing portion formed therein;

a rotary shaft that is supported by the bearing portion so as to pass through the base plate;

a winding drum formed integrally with the rotary shaft;

a rope reel that is rotatably supported at one side of the base plate opposite from an engine;

a recoil rope that is wound around the rope reel;

a recoil spiral spring that urges the rope reel to rewind the recoil rope;

a damper spring that has one end connected to the winding drum and the other end connected to the rope reel, the damper spring being disposed on a side of the rope reel opposite from the base plate, wherein the rope reel and the winding drum are rotatably and overlappingly supported on the bearing portion; and a clutch mechanism that is disposed on an end of the rotary shaft at the other side of the base plate facing the engine and that transfers a rotational force to the engine.

2. The recoil starter according to claim 1, wherein the base plate includes a partition wall that covers an opening of on a crankcase.

3. The recoil starter according to claim 1, wherein the base plate is disposed to cover an opening formed on a case of the engine.

4. The recoil starter according to claim 1, wherein the recoil spiral spring is disposed between the base plate and the rope reel.

5. A recoil starter comprising:

a base plate that has a bearing portion formed therein;

a rotary shaft that is supported by the bearing portion so as to pass through the base plate;

a winding drum that is integrally formed on one end of the rotary shaft;

a rope reel that is rotatably supported at one side of the base plate;

a recoil rope that is wound around the rope reel;

a recoil spiral spring that urges the rope reel to rewind the recoil rope;

a damper spring that has one end connected to the winding drum and the other end connected to the rope reel, wherein a base portion of the winding drum is embedded within a recessed portion formed on a side face of the rope reel; and a clutch mechanism that is disposed on the other end of the rotary shaft at the other side of the base plate and that outputs a rotational force.

6. The recoil starter according to claim 5, wherein the rope reel is positioned on the one side of the base plate, while the clutch mechanism is positioned on the other side of the base plate.

7. The recoil starter according to claim 6, wherein the rope reel is positioned nearer to the base plate as compared with the damper spring and the winding drum.

* * * * *